US010159327B2

(12) United States Patent
Drum-O'Neill et al.

(10) Patent No.: US 10,159,327 B2
(45) Date of Patent: Dec. 25, 2018

(54) MULTIPURPOSE OVERNIGHT BAG

(71) Applicant: TKABB, L.L.C., Millburn, NJ (US)

(72) Inventors: Carly Drum-O'Neill, Millburn, NJ (US); Michael O'Neill, Millburn, NJ (US)

(73) Assignee: TKABB, L.L.C., Millburn, NJ (US)

( * ) Notice: Subject to any disclaimer, the term of this patent is extended or adjusted under 35 U.S.C. 154(b) by 0 days.

(21) Appl. No.: 14/703,484

(22) Filed: May 4, 2015

(65) Prior Publication Data

US 2016/0324302 A1 Nov. 10, 2016

(51) Int. Cl.

| | |
|---|---|
| ***A45F 4/00*** | (2006.01) |
| ***A45F 4/06*** | (2006.01) |
| ***A45F 3/02*** | (2006.01) |
| ***A47G 9/08*** | (2006.01) |

(52) U.S. Cl.

CPC ..... *A45F 4/06* (2013.01); *A45F 3/02* (2013.01); *A47G 9/083* (2013.01)

(58) Field of Classification Search

CPC .... A45F 4/06; A45F 4/08; A47G 9/08–9/086; F21V 33/0008; A45C 15/06

USPC ..... 224/156; 362/156

See application file for complete search history.

(56) References Cited

U.S. PATENT DOCUMENTS 5,210,891 A * 5/1993 Avital ..... A45C 3/10 224/156
5,267,886 A * 12/1993 Wood ..... A63H 3/006 446/175
5,404,600 A * 4/1995 DeMars ..... A47G 9/086 5/413 R
6,421,852 B1 * 7/2002 Shao ..... A63H 3/005 446/73
7,058,997 B1 * 6/2006 Klinger ..... A47G 9/086 190/18 A
7,857,181 B2 * 12/2010 Sacks ..... A45F 3/14 224/578
7,987,536 B1 * 8/2011 Habig ..... A47G 9/083 5/413 R
2004/0127138 A1 * 7/2004 Huang ..... A63H 27/10 446/220
2007/0113338 A1 * 5/2007 Remblad ..... A45F 4/06 5/420
2007/0133195 A1 * 6/2007 Gorton ..... A45C 15/06 362/156
2008/0256705 A1 * 10/2008 Maguire ..... A47G 9/086 5/413 R
2009/0272777 A1 * 11/2009 Fraher ..... A45C 15/06 224/576

(Continued)

*Primary Examiner* — Peter N Helvey

(74) *Attorney, Agent, or Firm* — Saul Ewing Arnstein & Lehr LLP

(57) ABSTRACT

Described is a multipurpose overnight bag which includes a storage body and a sleeping bag coupled thereto, and which includes one or more shoulder straps connectable to the storage body to enable the multipurpose overnight bag to be carried by a user when it is configured in a "travel mode." The multipurpose overnight bag is configured such that when put into the travel mode the sleeping hag wraps completely around and cushions the storage body, thereby protecting the contents of the storage body and providing a plush and comfortable carrying experience for a user carrying it via the one or more shoulder straps.

12 Claims, 4 Drawing Sheets

(56) References Cited

U.S. PATENT DOCUMENTS

| | | | | |
|---|---|---|---|---|
| 2009/0316426 | A1* | 12/2009 | Gilligan | A45C 15/06<br>362/551 |
| 2012/0267383 | A1* | 10/2012 | Van Rooyen | A45C 13/08<br>220/694 |
| 2013/0228600 | A1* | 9/2013 | Teixeira | A45F 4/08<br>224/156 |
| 2014/0009928 | A1* | 1/2014 | Zhang | F21L 4/04<br>362/231 |
| 2015/0327647 | A1* | 11/2015 | Wiklacz | A45C 15/06<br>362/156 |
| 2016/0242520 | A1* | 8/2016 | Van Rooyen | A45C 13/08 |

* cited by examiner

MULTIPURPOSE OVERNIGHT BAG

BACKGROUND

Overnight bags are frequently used to carry a small number of items in a convenient manner. Backpacks are commonly used for this purpose, in many situations (e.g., overnight camping trips; child sleepovers) a sleeping bag is also needed. Sleeping bags can be cumbersome to carry separately and if stuffed into a backpack or other overnight bag, there is little room left for other items (clothes, books, stuffed animals, etc.).

SUMMARY OF THE INVENTION

Described is a multipurpose overnight bag which includes a storage body and a sleeping bag coupled thereto, and which includes one or more shoulder straps connectable to the storage body to enable the multipurpose overnight bag to be carried by a user when it is configured in a "travel mode" The multipurpose overnight bag is configured such that when put into the travel mode the sleeping bag wraps completely around and cushions the storage body, thereby protecting the contents of the storage body and providing a plush and comfortable carrying experience for a user carrying it via the one or more shoulder straps.

In an alternative embodiment, the storage body is made of a rigid material or is made of a soft material that is rendered semi-rigid via the inclusion of stiffening elements within the material.

In another embodiment, the storage body includes at least one flat side that lies flat a surface on which the sleeping bag is in a "deployed mode," and is connected to the sleeping bag at one end thereof, thus forming a "headboard" at an open end of the sleeping bag which can be leaned upon buy a user and/or provide easy access to items placed within storage body.

DEFINITIONS

The instant invention is most clearly understood with reference to the following definitions:

As used in the specification and claims, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. About can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Ranges provided herein are understood to be shorthand for all of the values within the range. For example, a range of 1 to 50 is understood to include any number, combination of numbers, or sub-range from the group consisting 1, 2, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

Unless specifically stated or obvious from context, as used herein, the term "or" is understood to be inclusive.

DETAILED DESCRIPTION OF THE INVENTION

Figure 1:
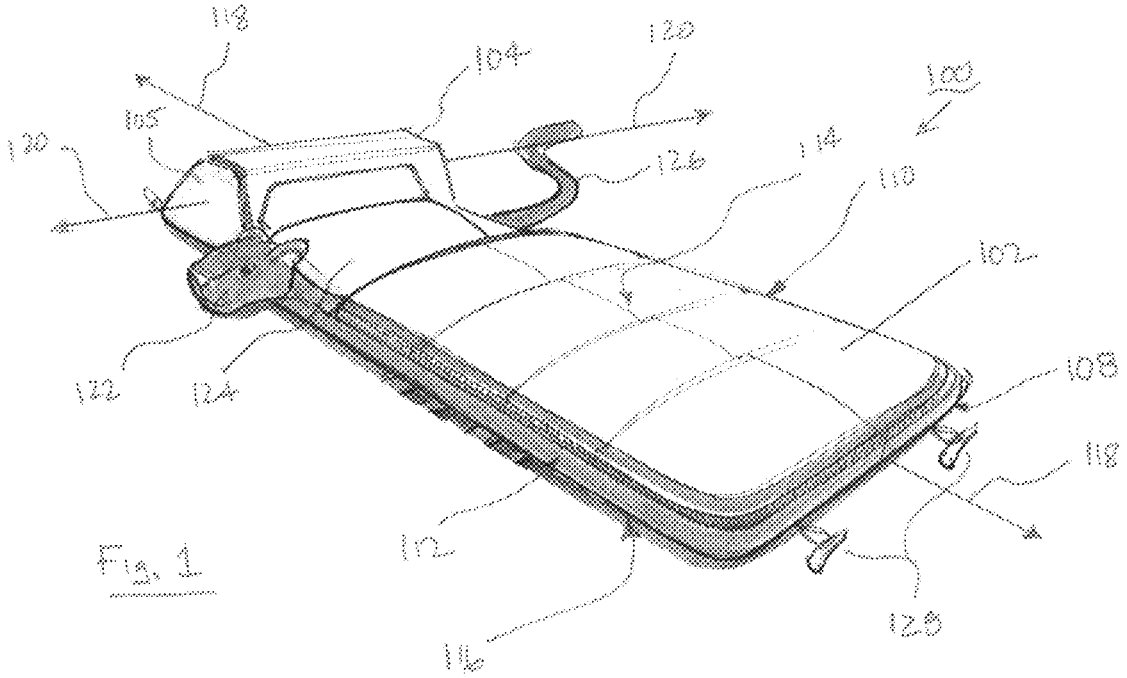
FIG. 1 shows a multipurpose overnight hag according to the present invention in a fully deployed mode configuration.

Referring to FIGS. 1 through 7, a multipurpose overnight bag 100 is shown. FIG. 1 best shows the multipurpose overnight hag 100 in a fully deployed mode configuration, and FIG. 3 best shows the multipurpose overnight hag 100 shown in its travel mode configuration.

Figure 2:
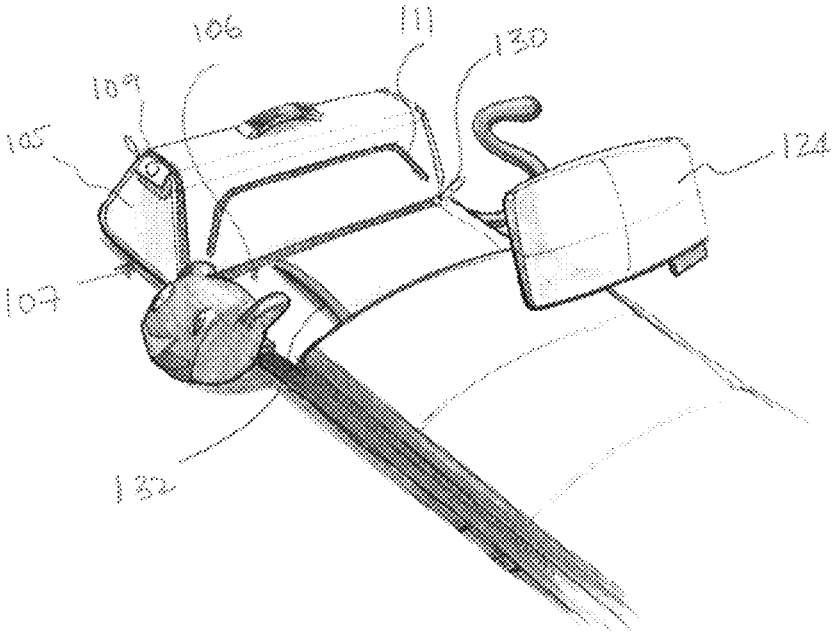
FIG. 2 shows a partial perspective view of a multipurpose overnight bag according to the present invention, showing a pillow removed, revealing a storage pocket for same.

Referring first now to FIGS. 1 and 2, the overnight bag 100 includes a sleeping bag 102 and a storage body 104. The sleeping hag 102 has a first end 106 (see FIG. 2), a second end 108, a first side 110 and a second side 112. Sleeping bag 102 also has a top surface 114 and a bottom surface 116 (which abuts the floor/ground when displayed as shown in FIG. 1). Sleeping hag 102, in the broadest embodiment, is a typical sleeping bag as is well known, e.g., a cloth "pouch" preferably filled with polyester fiber padding, down, or other such material and having a zipper around the perimeter on at least two sides, e.g., bottom 108 and second side 112. As described in more detail below, various modifications to this "typical" sleeping bag can be included to provide additional functionality and/or decorative features.

Figure 4:
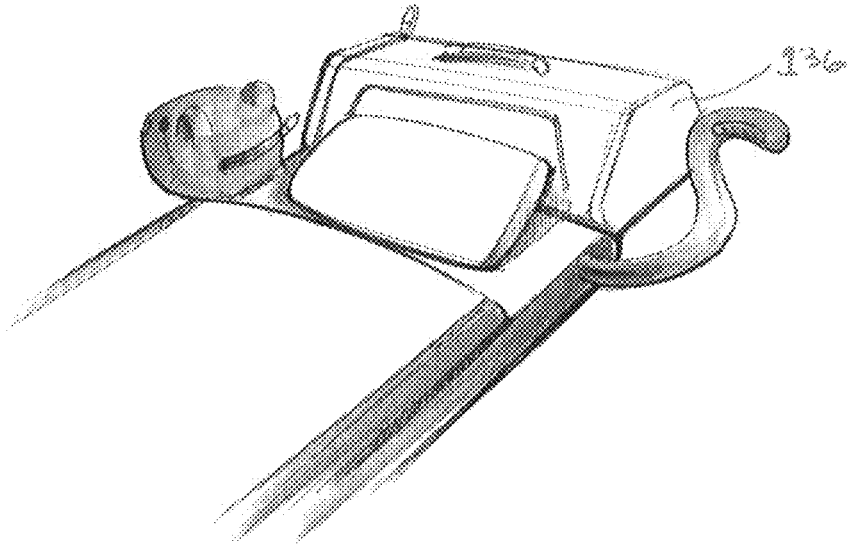
FIG. 4 shows an alternate partial perspective view of a multipurpose overnight bag according to the present invention.
Figure 5:
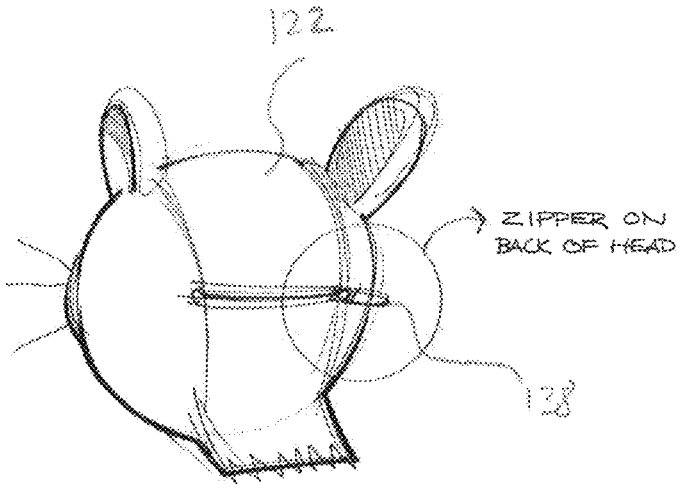
FIG. 5 shows an enlarged view of a decorative head of the present invention, illustrating a zipper pocket therein.

Storage body 104 includes a first end 105 and a second end 136 (see FIG. 4). An imaginary longitudinal axis 120 extends through storage body 104 as shown in FIG. 1. An imaginary longitudinal axis 118 extends through sleeping bag 102 as shown in FIG. 1. As shown, for example, in FIG. 1, sleeping bag 102 is coupled to storage body 104. In the preferred embodiment shown in FIG. 1, the first end 108 of sleeping bag 102 is coupled to storage body 104 along the longitudinal axis 120 of storage body 104, such that the longitudinal axis 118 of sleeping bag 102 is perpendicular to the longitudinal axis 120 of storage body 104, in a preferred embodiment, the first end 106 of sleeping bag 102 is connectable to storage body 104 via a zipper 130 (See FIG. 2). It is understood that any connection means can be used in place of zipper 130, e.g., simple hooks, ties, Velcro®, buckle clips, or the like.

As shown in the figures, in a preferred embodiment, the storage body 104 has at least one flat side, 107 as shown, for example, in FIG. 2. In a preferred embodiment, the storage body 104 is generally trapezoidal shaped as shown in the figures. However, it is understood that in the preferred embodiment, only side 107 need be flat, and the remainder of the surface can be any shape, e.g., curved rather than trapezoidal, resembling essentially a tube with one flat side to sit on the ground when deployed.

In the embodiment shown in the Figures, storage body 104 has two points of entry so that items can be stowed therein and accessed when needed. A first point of entry is formed by providing a zipper 109 on first end 105. As shown in FIG. 2, this zipper 109 can be positioned around a portion of the perimeter of first end 105, A second point of entry as shown in FIG. 2 is formed by placing a zipper 111 on a side of the storage body 104 that is easily accessible by a user of the sleeping bag sitting or lying on it, e.g., on a side of the storage body 104 that faces the sleeping bag, as shown in FIG. 2. Placing zipper 111 in this location gives easy access to the contents of the storage body 104 when the sleeping bag is in the deployed mode configuration.

The storage body 104 can be made of any material capable of being formed into a shape having a generally flat side 107. The material can be a softer less-rigid materials such as cloth, rip-stop nylon, sheet plastic, or like materials. It can also be a more rigid material such as high density polyethylene, polyvinyl chloride, polypropylene, or like materials. If softer less rigid materials are used, "stiffeners" can be included in seams or in inserts to add rigidity to the storage body 104 so that it can essentially "stand" on its own, even when unfilled with items.

In a preferred embodiment, a pillow 124 is also included for use by a user of the sleeping bag 110. As best shown in FIG. 2, if desired, a pocket or slot 132 can be provided into which the pillow 124 can be stored when not in use.

At the second end 108 of sleeping bag 102, in a preferred embodiment, fasteners 128 are provided which interact, when in the travel mode configuration, with corresponding fasteners 134 (see FIG. 3) situated on the bottom side of sleep bag 102. By way of example, for a sleeping bag 102 that is approximately 5 feet in length, used with a storage body 104 which has dimensions of approximately 18 inches in length by 8 inches in width by 6.5 inches in height, the complimentary fasteners 134 should be situated approximately 27-28 inches from the top of the sleeping bag. As noted above, FIG. 3 best illustrates the overnight bag of the present invention in the travel position. As can be seen, the sleeping bag is rolled around the storage body 104 and is fastened in place by fasteners 128 coupled to corresponding fasteners 134. Any type of fastener can be used, for example, simple hooks, ties, buckle clips, or the like.

Figure 3:
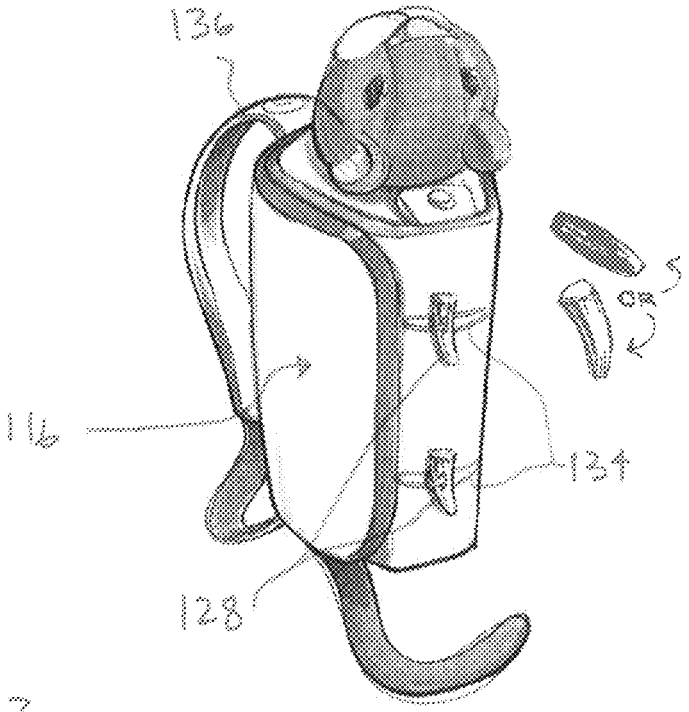
FIG. 3 shows a multipurpose overnight bag according to the present invention in a travel mode configuration.
Figure 6:
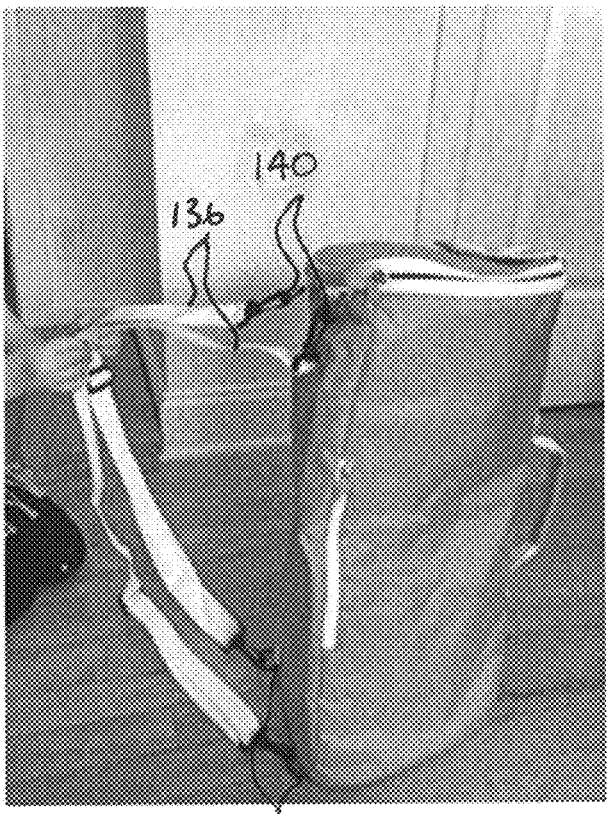
FIG. 6 shows an embodiment of a multipurpose overnight bag according to the present invention, in which D rings are attached to the bottom portion of the storage body, and connection means, e.g., spring hooks, boltsnaps, carabiner clips, etc., are provided for connecting straps to allow interconnection in a well-known manner.

Also shown in FIG. 3 are straps 136. As shown in FIG. 3, only a single strap 136 is shown. However, as can be seen in FIG. 6, multiple straps (two are shown) can be attached to make the device function as a backpack if desired. As shown in FIG. 6, in one embodiment, D ring 140 are attached to the bottom portion of the storage body 104, e.g., approximately at the four corners of the flat side 107 of storage body 104, and connection means, e.g., spring hooks, boltsnaps, carabiner clips, etc., are provided for connecting straps 136 to allow interconnection in a well-known manner.

In a preferred embodiment, the sleeping bag 102 can include first and/or second decorative elements 122 and 126, such as a stuffed animal head and a stuffed animal tail configured as shown. As can best be seen in FIG. 4, the head and tail (in this example) are attached on the sides of the sleeping bag 102, next to the top of the sleeping bag 102 and extending outward from the first side 110 and second side 112, respectively. In a preferred embodiment, they are detachably connected, e.g., through the use of zippers or other fasteners, so that they may be removed when the sleeping bag is to be washed. In a preferred embodiment, the head 122 includes a zipper 138 on its hack of the head, which opens to provide a storage area within the head for a child or other user of the device.

Figure 7:
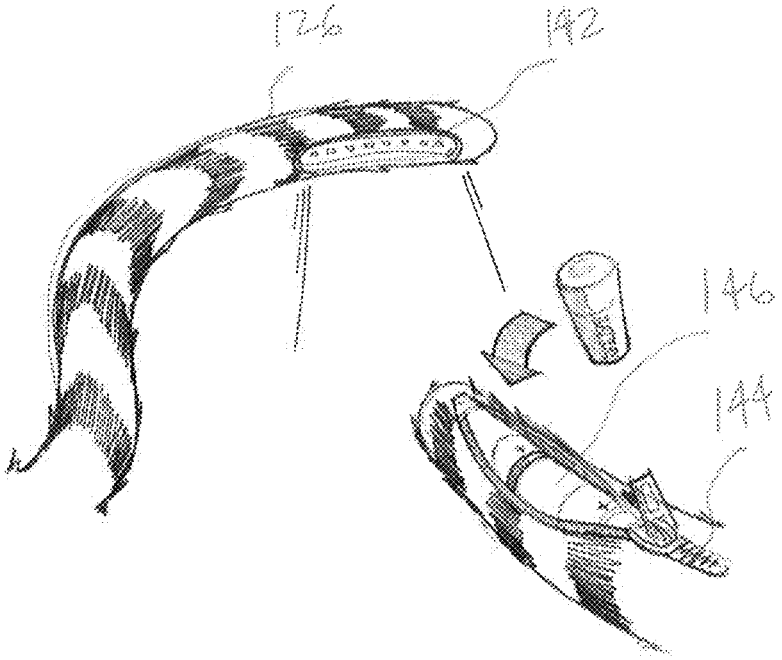
FIG. 7 shows a light element that can be provided at the tip of tail as shown with a zipper provided to enable the insertion of batteries to allow the operation of the light.

Further, as best seen in FIG. 7, if desired, a light element 142 can be provided at the tip of tail as shown with a zipper 144 provided to enable the insertion of batteries 146 to allow the operation of the light 142. The materials used for the sleeping bag 102 and storage element 104 are preferably decorated with prints or other markings that are consistent with the decorative elements, for example, if a tiger head and tail are used, the material used for the sleeping bag 102 could have tiger stripes printed thereon, as could the storage element 104. The light 142 can comprise any portable light (battery operated; solar powered, etc.) that can be situated within the tail 126 and emit light outward from the tail as shown, for example, in FIG. 7.

The head and tail shown in the drawings are shown for the purpose of example only, and it is understood that many other decorative add-ons, e.g., lion, horse, cat, alligators, moose, panda, elephant, pig, cow, sheep, raccoon, seal, koala, hippo, frog, bunny, zebra, whale, kangaroo, bear, dolphin, butterfly, bumblebee, buffalo, duck, dragon, shark, kitten, dog, puppies, unicorns, monkeys, turtles, leopards, giraffes, ladybugs, penguins, dinosaurs; or sports related decorative items, e.g., baseball, basketball, football, soccer, tennis, lacrosse, and the like could be used and all such decorative add-ons are considered to be covered by the appended claims.

To put the overnight bag in the travel position, the sleeping bag is rolled around the storage body, through the straps 136, and fastened using fasteners 128, as shown in FIG. 3. This provides the user with an easily carryable overnight bag which includes a sleeping bag and storage facilities for minor sundries, clothing, etc., that might be included on an overnight stay.

EQUIVALENTS

The functions of several elements may, in alternative embodiments, be carried out by fewer elements, or a single element. Similarly, in some embodiments, any functional element may perform fewer, or different, operations or functions than those described with respect to the illustrated embodiment. Also, functional elements (e.g., modules, computers, fasteners, straps and the like) shown as distinct for purposes of illustration can be incorporated within other functional elements, separated in different hardware, or distributed in a particular implementation.

While certain embodiments according to the invention have been described, the invention is not limited to just the described embodiments. Various changes and/or modifications can be made to any of the described embodiments without departing from the spirit or scope of the invention. Also, various combinations of elements, steps, features, and/or aspects of the described embodiments are possible and contemplated even if such combinations are not expressly identified herein.

What is claimed is:

1. A multipurpose overnight bag comprising;

a storage body having an internal portion, an external portion, a longitudinal axis, and first and second ends;

a sleeping bag, having first and second ends, first and second sides, a top surface and a bottom surface, and a longitudinal axis, said first end of said sleeping bag being connected to said storage body along the longitudinal axis of said storage body, with the longitudinal axis of the sleeping bag being approximately perpendicular to the longitudinal axis of said storage body when so connected;

a first decorative element attached to the second side of the sleeping bag, adjacent to the first end of the sleeping bag and extending outwardly from the second side, the first decorative element comprising an elongate first three-dimensional element replicating a known object, the first decorative element including an internal storage area and an openable orifice for accessing the internal storage area, and including a lighting element situated within the internal storage area thereof; and at least one shoulder strap, coupled to the storage body at said first and second ends of said storage body and forming a first loop; wherein:

the sleeping bag can be rolled around the storage body and through the first loop and is secured in a travel mode configuration using fasteners coupled to the sleeping bag, so that the top surface of the sleeping bag abuts and surrounds the external portion of the storage body; and the lighting element is retainable within the internal storage area such that when the lighting element is turned on it directs a light beam outward from the first decorative element such that the light beam can be directed to assist visibility in a dark environment.

2. The multipurpose overnight bag of claim 1, wherein said at least one shoulder strap comprises two essentially parallel backpack-style shoulder straps, each of which is coupled to the storage body at said first and second ends of the storage body.

3. The multipurpose overnight bag of claim 1, wherein the first end of the storage body compromises an openable end panel providing access to the internal portion of the storage body.

4. The multipurpose overnight bag of claim 3, further comprising an openable side panel situated along the external portion of the storage body, providing access to the internal portion of the storage body.

5. The multipurpose overnight bag of claim 3, further comprising a second decorative element attached to the first side of the sleeping bag, adjacent to the first end of the sleeping bag and extending outwardly from the first side.

6. The multipurpose overnight bag of claim 5, wherein the second decorative element comprises a second three-dimensional element replicating a known object.

7. The multipurpose overnight bag of claim 6, wherein the second decorative element includes an internal storage area and an openable orifice for accessing the internal storage area.

8. The multipurpose overnight bag of claim 6, wherein the second three-dimensional element replicating a known object comprises a replication of an animal head.

9. The multipurpose overnight bag of claim 6, wherein the second three-dimensional element replicating a known object comprises a replication of a piece of sports equipment.

10. The overnight bag of claim 8, wherein the first three-dimensional element replicating a known object comprises a replication of an animal tail corresponding to the animal head.

11. The overnight bag of claim 1, wherein when the multipurpose overnight bag is in the travel mode configuration, the first decorative element abuts the first end of the storage body and extends outwardly therefrom.

12. The overnight bag of claim 11, wherein when the multipurpose overnight bag is in the travel mode configuration, the second decorative element abuts the second end of the storage body and extends outwardly therefrom.

* * * * *